United States Patent [19]

Monkelbaan

[11] 4,114,431

[45] Sep. 19, 1978

[54] METHOD OF FORMING TUBULAR METAL PRODUCTS

[75] Inventor: Edwin R. Monkelbaan, Williamson, N.Y.

[73] Assignee: Xerox Corporation, Stamford, Conn.

[21] Appl. No.: 652,934

[22] Filed: Jan. 27, 1976

[51] Int. Cl.[2] ..... B21D 3/02

[52] U.S. Cl. ..... 72/122; 72/78

[58] Field of Search ..... 72/78, 75, 113, 117, 72/95, 122, 123

[56] References Cited

U.S. PATENT DOCUMENTS

| | | | |
|---|---|---|---|
| 600,013 | 3/1898 | McCool | 72/75 |
| 1,063,258 | 6/1913 | Haysom | 72/123 |
| 1,212,489 | 1/1917 | Jackson | 72/78 |
| 1,357,059 | 10/1920 | Ihsen | 72/122 |
| 1,506,988 | 9/1924 | Mirfield | 72/123 |
| 1,537,207 | 5/1925 | Wikstrom | 72/75 |
| 1,717,720 | 6/1929 | Martin et al. | 72/122 |
| 2,395,450 | 2/1946 | Browning | 72/123 |
| 2,575,938 | 11/1951 | Brenneke | 72/75 |
| 2,767,766 | 10/1956 | Mathews | 72/122 |
| 3,091,142 | 5/1963 | Szikla | 72/123 X |
| 3,222,905 | 12/1965 | Ernestus | 72/91 |

*Primary Examiner*—Leon Gilden

*Attorney, Agent, or Firm*—James J. Ralabate; James P. O'Sullivan; Donald M. MacKay

[57] ABSTRACT

A method of fabricating seamless tubes of malleable metal is provided comprising supporting an annular work piece of greater wall thickness than the required thickness of the completed tube within a die ring in encircling engagement with its outer surface and applying an axial pull to one end of said work piece to draw it axially through said die ring while simultaneously rolling the interior of the work piece with a forming tool having a plurality of centrifugally loaded rollers so as to enlarge the internal diameter and lengthen the work piece axially in the direction of said axial pull.

6 Claims, 4 Drawing Figures

METHOD OF FORMING TUBULAR METAL PRODUCTS

BACKGROUND OF THE INVENTION

The invention relates to the forming of cylindrical metal tubular articles which are suitable for use as seamless photoconductive substrates. More particularly, the invention is directed to an improved method of forming an elongated, relatively thin-walled cylindrical tube from an annular work piece of considerably greater thickness by the simultaneous reduction of wall thickness and elongation of the tube.

A method of simultaneously reducing the internal diameter of a tubular work piece while lengthening the tube is taught by Ernestus, in U.S. Pat. No. 3,222,905. As disclosed therein, a cylindrical work piece is supported within a die ring in encircling engagement with its outer surface and the combination rotated while a stationary forming tool within the work piece reduces the internal diameter. Further, the forming tool comprises a series of rollers which are adjusted in a fixed position relative to the work piece. This invention is directed to an improvement of the method taught by Ernestus.

BRIEF DESCRIPTION OF THE INVENTION

Succinctly stated, the invention comprises fabricating seamless tubes of malleable metal suitable for use as photoconductive substrates such as formed of nickel comprising the simultaneous lengthening and increase of the internal diameter of a tube. The work piece is encircled within a die ring and an axial pull applied to one end of said work piece to draw it axially through said die ring while simultaneously rolling the interior of the work piece with a forming tool having a plurality of centrifugally loaded rollers. In preferred embodiments, the work piece is fixed to prevent circumferential rotation of the work piece and the forming tool comprises a rolling head having equally spaced centrifugally loaded rollers fixed in a barrel which can be easily withdrawn to permit removal and insertion of a new work piece.

DETAILED DESCRIPTION OF THE INVENTION

Figure 1:
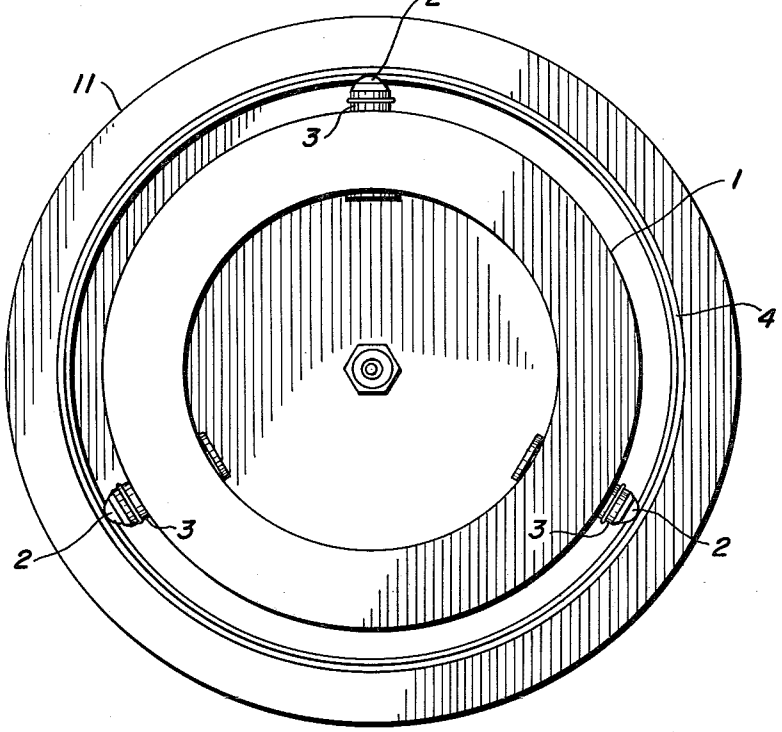
Referring now to FIG. 1, there is depicted a forming tool comprising a generally cylindrical spider 1 composed of rollers 2 fixed in barrels 3 in operative contact with work piece 4.

In general, a tubular work piece is mounted in an apparatus as shown in FIG. 1 of Ernestus, U.S. Pat. No. 3,222,905 which is herein incorporated by reference in its entirety. As opposed to the internal rollers of fixed location as taught therein, the invention employs a forming tool having a plurality of centrifugally loaded rollers. In addition, the work piece is preferably held stationary while the internal rollers are rotated although the work piece may be rotated either in the same direction or in counter-rotation to the internal rollers. Inasmuch as the hardware and method for axially pulling the work piece are adequately taught in said patent, the description herein is directed to the forming tool for increasing the internal diameter of the work piece.

Referring now to FIG. 1, a forming tool is depicted comprising a generally cylindrical spider, having equally spaced rollers 2 fixed in barrels 3 in operative contact with work piece 4. Die ring 11 encircles the work piece to support and provide compressive contact with the work piece.

Figure 2:
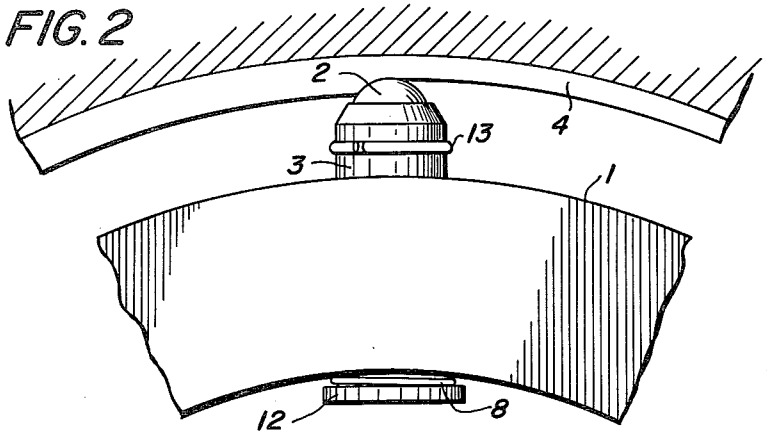
FIG. 2 depicts the barrel in detail in operative contact with the work piece.

Referring to FIG. 2 where a single barrel 3 is illustrated in detail, roller 2 is shown in rolling contact with the work piece. A spring 8 serves to withdraw the barrel when the rotation is stopped, and 12 is a flange and 13 a retainer ring which confines barrel 3 within chamber 7.

Figure 3:
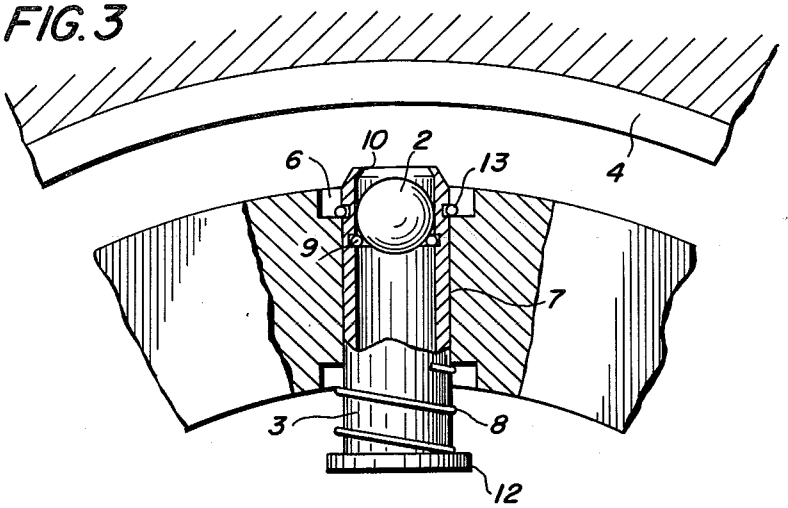
FIG. 3 depicts the barrel withdrawn from the work piece so as to permit removal and insertion of a new work piece.
Figure 4:
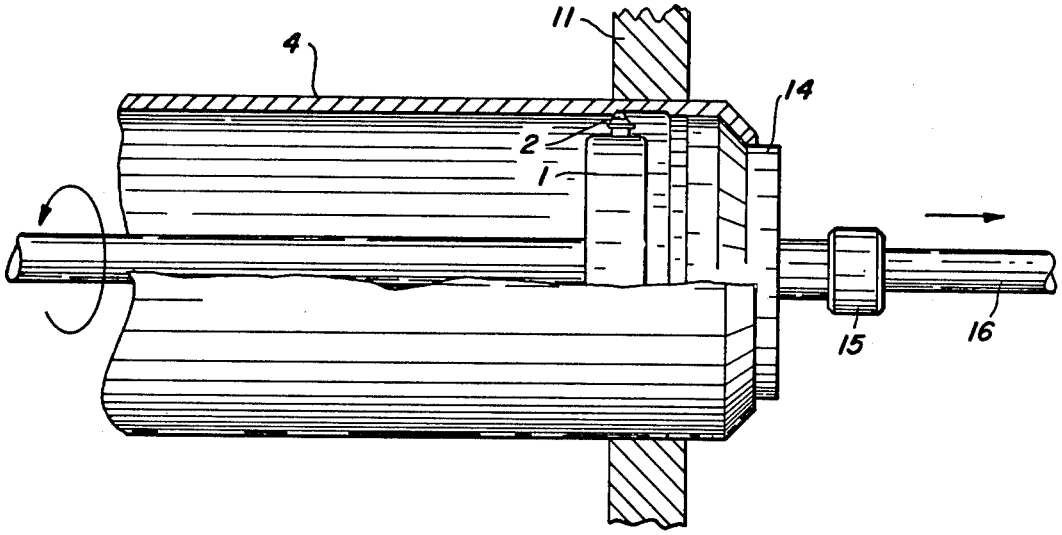
FIG. 4 depicts an axial sectional view schematically illustrating the roll-forming stage.

In FIG. 3 barrel 3 is shown with roller 2 in a stationary position withdrawn from the work piece so as to permit removal and insertion of a new work piece. Roller 2 is also shown resting on retainer ring 9, and spring 8 is at rest. Lips 10 contain the roller within the barrel when it is rotated and the barrel is confined within chamber 7 by retainer ring 13 and flange 12. Recess 5 is for containing spring 8 and serving as a stop for barrel 3. Recess 6 allows the barrel 3 to be retracted, and the shoulder at the bottom of 6 acts as a stop in conjunction with retainer ring 13 and flange 12 to confine barrel 3 within channel 7.

Draw head 14 applies an axial pull to one end of workpiece 1 which by means of coupling 15 is connected to draw shaft 16 which in turn is connected to a hydraulic cylinder, not shown.

Referring now to FIG. 1 the work piece is drawn through the die ring 11 while its interior is rolled, thereby enlarging its internal diameter, reducing its wall thickness, extruding it axially with the assistance of the axial pull applied by a draft unit, and drawing it through the die with a sizing operation on its outer surface. The elongation of the work is accompanied and assisted by drawing out the work axially in response to a tension load applied to one end thereof while the other end is free to follow through the die at a rate of axial travel that is somewhat slower than the rate of axial movement of the end that is being pulled, the differential representing elongation of the article. The die through which the work is pulled maintains the outer diameter of the work exactly uniform, corresponding to the inner diameter of the die which in turn corresponds to the required outer diameter of the finished article. As the successive passes of rolling operation successively move the inner wall of the work outwardly, the extruded metal has but one direction in which to move, namely, parallel to the axis of the tubular shape, and the resulting elongation occurs without any distortion from the true cylindrical shape which is imposed on the article by the encircling die. Furthermore, since the forces imposed upon the wall of the tubular work piece are confined to (a) the radial squeezing effect, (b) the axial pull drawing the work through the die, and (c) the longitudinal extrusion of excess metal which is absorbed by the elongating area of the work immediately beneath the rolls and does not pile up ahead of the rolls, there is no resultant tearing or fissuring of the wall structure but on the contrary, the tensile and compressive strength of the wall structure is increased by the compacting action of the rolls.

A series of consecutive axial passes of the rolling head is executed until the work has been reduced to the selected wall thinness and axial length. During all of these successive passes, the outer wall of the work is maintained at an accurately uniform diameter and true cylindrical contour by the sizing operation of the inner wall of die 11 as the work is drawn through it while subjected to the outward pressure of rollers 2. Wrinkling does not occur for the reason that the work is completely restrained by the tightly encircling embrace of die 11 in the area where it is being subjected to the extrusive action of the rollers 2 gradually moving the excess metal axially so as to elongate the work.

Having described the present invention with reference to these specific embodiments, it is to be understood that numerous variations can be made without departing from the spirit of the invention and it is intended to encompass such reasonable variations or equivalents within its scope.

What is claimed is:

1. A method of fabricating seamless tubes of malleable metal including the following steps:

preparing an annular work piece of greater wall thickness than the required thickness of the completed tube;

supporting the work piece within a die ring in encircling engagement with its outer surface;

applying an axial pull to one end of said work piece to draw it axially through said die ring and simultaneously centrifugally rolling the rollers of a forming tool against the interior surface of said work piece, while said work piece is encircled by said die ring, with solely centrifugal force sufficient to enlarge by deformation its internal diameter and axially lengthen the work piece, said centrifugal rolling being accomplished by spinning said tool at a high rotational speed.

2. The method of claim 1 wherein said work piece is fixed to prevent circumferential rotation.

3. The method of claim 1 wherein said work piece and die ring are rotated during said interior rolling.

4. The method of claim 1 wherein said forming tool has three equally spaced rollers.

5. The method of claim 1 wherein said rollers are fixed in a barrel in operative contact with said work piece when the forming tool is rotated but out of contact with the work piece when the forming tool is at rest to permit removal and insertion of a new work piece.

6. The method of claim 1 wherein said rollers are fixed in a barrel in operative contact with the work piece when the forming tool is rotated but wherein the barrel is withdrawn from the work piece when the rolling head is at rest by a spring so as to permit easy removal and insertion of a new work piece, said spring being insufficient to retain the roller from forming contact with the work piece when the forming tool is rotated at a speed sufficient to increase the internal diameter of the work piece.

* * * * *